US006691699B1

(12) United States Patent
Fafet et al.

(10) Patent No.: US 6,691,699 B1
(45) Date of Patent: Feb. 17, 2004

(54) COOKING PLATE

(75) Inventors: Gérald Fafet, Carrière sur Seine (FR); Hélène Harmand, Paris (FR); Vincent Halbin, Château-Thierry (FR); Pablo Vilato, Paris (FR)

(73) Assignee: Eurokera, Chateau-Thierry (FR)

( * ) Notice: Subject to any disclaimer, the term of this patent is extended or adjusted under 35 U.S.C. 154(b) by 0 days.

(21) Appl. No.: 10/111,375

(22) PCT Filed: Nov. 22, 2000

(86) PCT No.: PCT/FR00/03244

§ 371 (c)(1),
(2), (4) Date: Apr. 24, 2002

(87) PCT Pub. No.: WO01/38796

PCT Pub. Date: May 31, 2001

(30) Foreign Application Priority Data

Nov. 24, 1999 (FR) ..... 99 14770

(51) Int. Cl.[7] ..... F24C 3/00

(52) U.S. Cl. ..... 126/39 R; 126/39 J; 126/215; 126/214 A

(58) Field of Search ..... 126/39 R, 39 J, 126/214 R, 215, 39 H, 39 K

(56) References Cited

U.S. PATENT DOCUMENTS

| | | | | |
|---|---|---|---|---|
| 3,830,216 A | | 8/1974 | Dodd | |
| 5,549,100 A | | 8/1996 | Naubik et al. | |
| 6,129,545 A | * | 10/2000 | Kahlke et al. | 126/39 J |
| 6,196,212 B1 | * | 3/2001 | Taplan et al. | 126/39 R |
| 6,508,245 B2 | * | 1/2003 | Taplan | 126/39 R |

* cited by examiner

*Primary Examiner*—James C. Yeung
(74) *Attorney, Agent, or Firm*—Oblon, Spivak, McClelland, Maier & Neustadt, P.C.

(57) ABSTRACT

A hotplate, such as a plate of vitreous ceramic, intended to equip a cooker having at least one gas burner, includes a raised zone intended to cover the gas burner. The raised zone includes orifices.

18 Claims, 1 Drawing Sheet

COOKING PLATE

BACKGROUND OF THE INVENTION

1. Field of the Invention

The invention relates to a hotplate intended to equip a cooker such as a hob comprising at least one gas burner. According to the invention, the hotplate is made of vitreous ceramic or of another material resistant to high temperatures and having a low coefficient of expansion.

In order to simplify its explanation, the invention will be described with reference to vitreous ceramic plates. Such an explanation of the invention must not in any way lead to the invention being interpreted as being restricted to this material.

2. Description of the Related Art

Gas cookers or hobs with gas burners, the top plate being made of vitreous ceramic, are known in the prior art.

Such gas burners are, in the usual way, arranged in a structure, usually made of metal, known as the carcass and covered with a vitreous ceramic plate equipped with a surround which closes the structure.

The objective in designing these cookers has been for them to be substitutes for more conventional cookers usually consisting of an enamelled sheet on which the gas burners are positioned and of a metal grating which covers them.

This substitution has allowed this type of cooker to reach new aesthetic heights. Furthermore, the use of a vitreous ceramic plate makes cleaning easier.

Thus, document EP-A 879 797, for example, discloses a device for mounting gas burners in holes made in a vitreous ceramic plate forming the upper part of a cooker.

Document DE-U 298 05 620 describes such a cooker and, more particularly, mounting means that allow the gas burners to be attached to the vitreous ceramic plate with seals to make the connection between the vitreous ceramic plate and the gas burner.

Again, document W097/00407 describes such a cooker in which the gas burners are surrounded by elements to support cooking utensils used for cooking food.

Patent FR-B-2 735 562 describes cookers comprising a vitreous ceramic plate supporting the gas burners and also fulfilling the function of supporting the cooking utensils.

It is also known practice for such cookers to be produced in which the cooking utensils are supported by the upper part of the gas burner.

These various types of embodiment of cooker have gas burners associated with a vitreous ceramic plate which forms the main upper part of the cooker and have in common the ease of cleaning the upper surface, the latter being formed of a vitreous ceramic plate. The only zones of the cooker which remain difficult for the user in terms of upkeep are the zones containing the gas burners; specifically, these burners have to be at least partially dismantled then refitted in order to be cleaned satisfactorily.

SUMMARY OF THE INVENTION

The inventors have therefore set themselves the task of offering the possibility of providing a cooker comprising at least one gas burner and the upper part of which is formed of a hotplate, such as a vitreous ceramic plate, for which cleaning is made even simpler than is allowed by the currently known products.

This objective has been achieved, according to the invention, by a hotplate, such as a plate of vitreous ceramic, intended to equip a cooker comprising at least one gas burner, the said vitreous ceramic hotplate comprising a zone intended to cover the gas burner and the said zone having orifices, designed, in particular, to form an air inlet to the gas burner and to allow the flames out.

According to the invention, the gas burner is completely concealed by the hotplate and is therefore invisible to the user; such a design provides a twofold simplification to the cleaning of the cooker. Specifically, first of all, the gas burner, which is concealed, is protected from mess and therefore less likely to become soiled. Furthermore, when the user cleans the visible part of the cooker, he has simply to clean the hotplate, this considerably simplifying the operation by comparison with the cleaning of the cookers currently available.

Furthermore, such a design of the cooker gives a new aesthetic appearance which follows the recent trends, namely a clean look with the least possible number of visible functional elements. Specifically, the cooker which has a gas burner shows only the orifices which, as already stated, are designed on the one hand to allow air to the burner and, on the other hand, to allow flames to be formed and to exit at the upper surface of the hotplate so as to heat the cooking utensils.

Advantageously according to the invention, the orifices are holes and/or slots. Such orifices may be made by techniques known to those skilled in the art such as, in particular, laser cutting or waterjet cutting techniques. According to the various types of design, the orifices may either act simultaneously as air inlets and as flame outlets, or be split into two categories, the first forming the air inlet and the second the flame outlet.

According to a preferred embodiment of the invention, the hotplate is capable directly, that is to say without intermediate elements, of supporting cooking vessels or utensils over the gas burner.

A first variant of the invention makes provision for the zone covering the gas burner to be capable of contributing to supporting the cooking utensils. In this variant, this zone covering the gas burner may have at least one raised part on which a cooking utensil can rest, at least in part.

A second variant makes provision for the hotplate to comprise bosses distributed at the periphery of the zone covering the gas burner. Thus, cooking utensils can rest on these bosses of which, for the cooking utensils to be properly stable, there are preferably at least three.

According to a third variant, the invention makes provision for a combination of the first two variants, namely for the zone covering the gas burner to be designed to support cooking utensils in association with bosses distributed at its periphery.

A first design of the invention consists in producing the hotplate in at least two separate elements, a first, essentially flat, element comprising at least one opening, in which the gas burner will be housed, and a second element intended to close off the said opening and forming at least part of the zone covering the gas burner. The second element may have the shape of a cap, the geometry of which remains arbitrary and chosen particularly for aesthetic considerations; the overall shape of this element may, for example, be circular, parallelepipidal, star-shaped, etc. This cap may be formed of an essentially flat upper part which is raised with respect to the plane of the first element, able in particular to at least contribute to supporting the cooking utensils, and of vertical or slightly inclined side walls. The upper part of the cap which may contribute to supporting the cooking utensils may be either smooth or may have a relief making it possible, for example, to avoid slippage.

As a preference, the orifices are formed in the second element which may have the shape of a cap and more particularly in the side walls thereof.

This assembly formed by the two elements that make up the hotplate needs to be correctly sealed where the two elements meet so that water, for example used to clean the visible surface of the hotplate, cannot penetrate inside. Furthermore, from a hygienic point of view, as such a plate is used for the preparation of food, it is necessary to avoid any risk of soiling so that germs will not proliferate. Provision is thus advantageously made for the two elements to be assembled via a seal, for example made of silicone, placed on the first, essentially flat, element, the second element coming into contact with this seal which is crushed under the weight of the said second element, sealing thus being achieved. Furthermore, one element may advantageously be fixed with respect to the other simply under the weight of the second element, and by indexing the latter with respect to the first element. It is thus possible to form a barrier, particularly against water, and as the attachment is simple, the two elements can be separated at any time for more intense cleaning and, in particular, to avoid the proliferation of germs at the seal.

According to a second preferred design of the invention, the hotplate is essentially flat and has at least one deformed zone which has the orifices and which covers the gas burner. Also as a preference, the deformed zone represents, with respect to the main plane of the plate, at least one boss and/or one recess. This deformation of the plate advantageously includes an essentially flat part raised up with respect to the main plane of the plate. Advantageously also, it has roughly vertical or inclined side walls in which the orifices are made.

Like the second element in the case of the two-element embodiment, the deformed zone may have an overall shape which is independent of its function and which may be chosen arbitrarily. The upper part which may advantageously be flat and at least partially contribute to supporting cooking utensils, may be either smooth or have a relief. This embodiment of the invention made as a single element with at least one deformed zone can be achieved according to the teaching of document FR-B-2 735 562.

Whatever the embodiment of the hotplate according to the invention, it is clear that the said hotplate, associated with a gas burner, now leaves only orifices still showing. Specifically, according to the invention, there is now no burner emerging through the plate and possibly supported thereby, the burner being wholly located under the hotplate. A gas burner more particularly suited to this design is a burner with a high primary ventilation rate.

The inventors have also envisaged simplifying the gas burner by using the zone that covers it to form part of the combustion chamber thereof. Specifically, for example the deformed zone of the hotplate may constitute the upper part of the combustion chamber. It is also possible, according to another advantageous embodiment, for this deformed zone also to substitute for the part of the burner which has orifices where the flames are formed, it being possible according to certain embodiments of the invention for the said deformed zone to itself have orifices designed for the passage of the flames.

According to other embodiments, the inventors also make provision for electrical heating elements such as radiant elements to be associated with this design, these other elements being inserted between the gas burner and the hotplate. According to such embodiments, the electric heating element may be fixed, for example, to the upper part of the combustion chamber of the gas burner. This type of embodiment may allow electrical heating to be substituted for gas heating, for example for warming a dish.

The invention also makes provision for making hotplates designed to equip hybrid cookers, that is to say ones which may have gas rings associated with radiant electrical, halogen and/or induction rings. For this type of hotplate, the inventors advantageously envisage producing all the zones intended to cover a cooking ring in the same way, that is to say in accordance with what has just been described, so as to offer a cooker with a uniform appearance.

BRIEF DESCRIPTION OF THE DRAWINGS

Other details and advantageous features of the invention will emerge hereinafter from the description of one exemplary embodiment of the invention with reference to FIGS. 1 and 2, which depict.

DETAILED DESCRIPTION OF THE PREFERRED EMBODIMENT

To assist with their understanding, the figures are not to scale.

Figure 1:
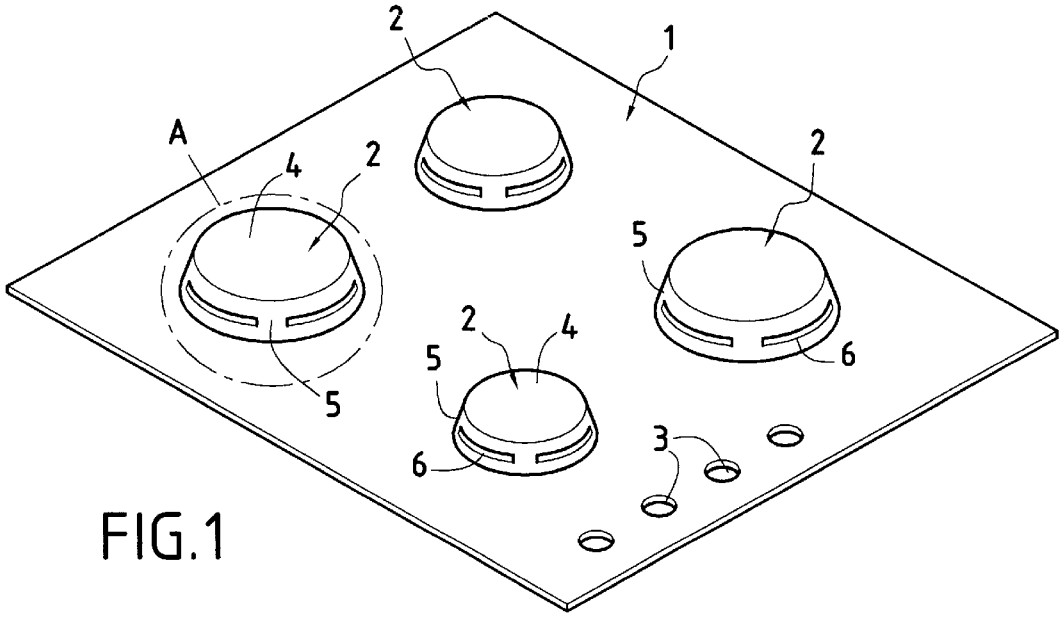
- FIG. 1, a schematic perspective view of a vitreous ceramic plate produced according to the invention,
- FIG. 2, an enlarged view of part of FIG. 1.

FIG. 1 depicts a vitreous ceramic plate 1 made as a single piece and designed to form four gas rings at the four locations 2 which are in relief on the plate. The vitreous ceramic plate 1 also comprises four holes 3 which are designed for the spindles of the gas burner controls to pass through. The presence of the holes 3 and their location must not lead to the invention being interpreted in a restrictive way; they may indeed not be present, for example when the controls are installed independently of the plate or in the case of sensitive controls, and when they are present, their distribution may be different.

The four locations 2 are produced according to the technique taught by patent FR-B-2 735 562 which describes a method for producing bosses by deformation forming an integral part of the vitreous ceramic plate.

It is therefore apparent that, according to the invention, the vitreous ceramic plate will wholly cover the gas burners, which are fitted in a support carcass or surround not depicted in the figures, to form a cooker. According to variants of the invention and as explained hereinabove, it is possible to associate this type of vitreous ceramic plate with gas burners, the manufacture of which is simplified or at least scaled down; specifically, it is possible to make provision for a deformed part 2 of the vitreous ceramic plate to constitute at least the upper part of the combustion chamber of the gas burner.

In the embodiment set out in the figures, the deformations 2 made have also the function of supporting the cooking utensils such as saucepans. The diameters likely to contribute to supporting are designed to have diameters that vary from one location 2 to another, as is the case in more conventional cookers; specifically, the diameters of the support elements or, more precisely, the diameters of the gas burners, are usually designed with dimensions which vary on one and the same cooker so as to be suited to cooking utensils or saucepans of different sizes. Thus, the upper surfaces 4 of the deformations 2 intended to cover the gas burners have been made flat to offer stable support to utensils such as saucepans. According to other embodiments, the surface of a deformation may itself have a more or less pronounced relief either to form a roughness and prevent slippage or to constitute point supports between which the air or the combustion gases can flow under the bottom of the cooking utensil.

Figure 2:
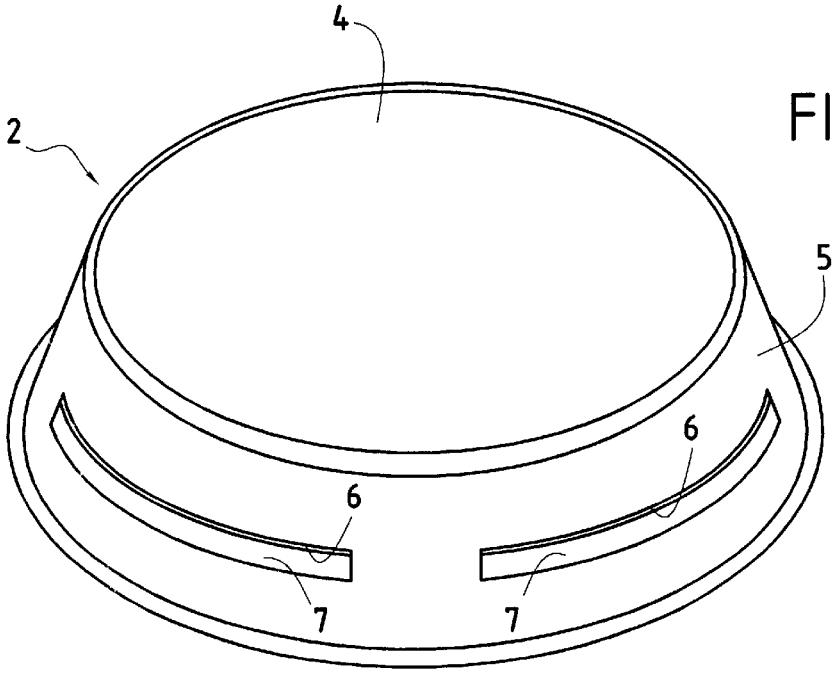

Better depicted in FIG. 2, which is an enlarged view of region A in FIG. 1, the deformations 2 according to this embodiment of the invention consist of an upper part 4 and of a side part 5 which forms an inclined plane. This inclined plane also has slots 6 distributed about the periphery of the deformation 2. These slots 6 are produced after the plate has been deformed by any means known to those skilled in the art, such as waterjet cutting or laser cutting. The invention also makes provision, according to other embodiment variants, for the orifices or slots 6 to be produced before the plate is deformed. These slots 6 are designed, on the one hand, to form the output orifices for the flames and, on the other hand, to allow air to the gas burner. These slots 6, as far as flame outlet is concerned, are superposed on or substituted for, particularly when the vitreous ceramic plate constitutes the top part of the combustion chamber, the flame outlet orifices of the burner. Specifically, and at least as far as appearances go, the flames, as far as an external observer, and particularly the user, is concerned, originate from these slots. This novel design of a cooker with gas burners therefore truly offers a new appearance, and does so also when using the burners because the flames seem to take shape on the vitreous ceramic plate.

According to other embodiments, it is possible to separate the functions of supplying air to the burner and of letting the flames out, for example by forming two levels of orifices on the periphery of the deformation 2. For example, it is possible to provide a lower level consisting of slots for the air inlet and an upper level allowing the flames out and consisting of holes also distributed around the entire periphery.

It is also possible according to the invention to make provision for for all of these orifices 6 formed on the lateral part 5 of the deformations 2 to have an internal shape, not depicted in the figures, for example provided on the lower zone 7, which forms a barrier against the ingress of liquid into the gas burner. Such an internal shape may be a simple inclined plane or a more complex shape defined particularly according to the shape of the orifices 6, to their positions and to the inclination of the side wall 5. This internal shape of the orifices 6 may be obtained directly during the stage of cutting the orifices 6, or by later shaping.

Such an embodiment of the vitreous ceramic plate 1 according to the invention therefore offers a surface consisting of a simple material and, according to this embodiment, made of a single element which, aside from having an appearance which is novel for cookers with gas burners, will very advantageously allow the upkeep of such a device to be simplified by comparison with the products which currently exist.

As regards the upkeep or repair of the gas burners, and more generally of all the elements located under the vitreous ceramic plate when the cooker is produced, the inventors have advantageously envisaged an assembly with the carcass which allows easy access to the burners; such an assembly for example envisages a device of the hinge type which allows the vitreous ceramic plate 1 to be lifted up completely without fully detaching it from the carcass and therefore without any problem of refitting or repositioning it. Such a device is naturally accompanied by suitable seals around the entire periphery so as to provide sealing when the vitreous ceramic plate 1 is in the functional position.

The vitreous ceramic plate 1 depicted in the figures must not lead to the invention being interpreted in a restrictive manner; specifically, the invention is aimed at any type of vitreous ceramic plate intended to cover at least one gas burner. Such a plate may therefore have one single location 2 or several depending on the cooker that is to be produced, the four-location embodiment being merely one example. Furthermore, the vitreous ceramic plate may also be intended to cover, in addition to one or more gas burners, other types of cooking element such as radiant electric, halogen and/or induction elements.

The inventors have also envisaged keeping such a vitreous ceramic plate 1, that is to say one with four deformed locations 2, when, for example, two gas burners are associated with two radiant electric, halogen and/or induction heating elements, possibly without forming the orifices over the electrical elements. Such an embodiment makes it possible to maintain a uniform overall appearance of the vitreous ceramic plate. It is also possible to make such deformations 2 only over the gas burners and to keep the plate flat when it covers electrical elements, to guarantee that the various zones can be recognized.

What is claimed is:

1. A hotplate, for a cooker comprising at least one gas burner, comprising a substantially planar plate, wherein said plate comprises at least one zone in the form of at least one boss and/or recess with respect to the main plane of said plate, positioned over said at least one burner, said zone being either a deformation of the plate or the plate and zone being formed of at least two parts which are continuous with one another, said zone having at least one orifice.

2. The hotplate according to claim 1, wherein the at least one orifice is at least one of slots and holes.

3. The hotplate according to claim 1, wherein the plate is capable of directly supporting cooking vessels or utensils over the gas burner.

4. The hotplate according to claim 3, wherein the zone covering the gas burner is capable of contributing to the supporting of the cooking vessels or utensils.

5. The hotplate according to claim 3, wherein said zone has bosses distributed at the periphery of the zone covering the gas burner to at least contribute to the supporting of the cooking vessels or utensils.

6. The hotplate according to claim 1, wherein the hotplate comprises a first, substantially flat, element comprising an opening and a second element intended to close off the said opening and forming at least part of the zone covering the gas burner.

7. The hotplate according to claim 6, wherein the second element has the orifices.

8. The hotplate according to claim 1, wherein said zone which has the orifices and which covers the gas burner is deformed.

9. The hotplate according to claim 8, wherein the deformed plate represents, with respect to the plane of the plate, at least one boss or recess.

10. The hotplate according to claim 8, wherein the zone has an essentially flat part which is raised with respect to the plane of the plate.

11. The hotplate according to claim 8, wherein the zone has roughly vertical or inclined side walls in which the orifices are made.

12. The hotplate according to claim 1, wherein the zone covering the gas burner constitutes part of the gas burner.

13. A cooker comprising at least one gas burner, further comprising a hotplate comprising a substantially planar plate, wherein said plate comprises at least one zone in the form of at least one boss and/or recess with respect to the main plane of said plate, positioned over said at least one burner, said zone being either a deformation of the plate or the plate and zone being formed of at least two parts which are continuous with one another, said zone having at least one orifice.

14. The cooker according to claim 13, further comprising at least one radiant electrical, halogen and/or induction cooking element.

15. A hotplate for a cooker having at least one gas burner, wherein the hotplate comprises:

a substantially planar plate; and a raised zone positioned over said at least one burner, wherein said raised zone is elevated with respect to said substantially planar plate, and wherein said raised zone includes at least one orifice, the entirety of said at least one orifice being elevated with respect to said substantially planar plate.

16. The hotplate according to claim 15, wherein said raised zone comprises a boss and wherein said at least one orifice is in the side wall of the boss.

17. A cooker comprising:

at least one gas burner; and a hotplate comprising a substantially planar plate and a raised zone positioned over said at least one burner, wherein said raised zone is elevated with respect to said substantially planar plate, and wherein said raised zone includes at least one orifice, the entirety of said at least one orifice being elevated with respect to said substantially planar plate.

18. The cooker according to claim 17, wherein said raised zone comprises a boss and wherein said at least one orifice is in the side wall of the boss.

* * * * *